United States Patent [19]

Bondpä

[11] Patent Number: 5,032,303

[45] Date of Patent: Jul. 16, 1991

[54] METHOD IN THE PROCESSING OF ALUMINUM AND THE USE OF CERTAIN ACIDS IN OILS THEREFOR

[75] Inventor: Ulf Bondpä, Nynäshamn, Sweden

[73] Assignee: Nynas Industri AB, Nynashamn, Sweden

[21] Appl. No.: 411,496

[22] PCT Filed: Feb. 13, 1989

[86] PCT No.: PCT/SE89/00061

§ 371 Date: Oct. 10, 1989

§ 102(e) Date: Oct. 10, 1989

[87] PCT Pub. No.: WO89/07638

PCT Pub. Date: Aug. 24, 1989

[30] Foreign Application Priority Data

Feb. 15, 1988 [SE] Sweden ..... 8800502

[51] Int. Cl.[5] ..... C10M 129/26; C10M 129/52

[52] U.S. Cl. ..... 252/56 R; 72/42

[58] Field of Search ..... 252/52 R, 56 R; 72/42

[56] References Cited

U.S. PATENT DOCUMENTS

| | | | |
|---|---|---|---|
| 2,990,943 | 7/1961 | Turnisky | 72/42 |
| 3,050,466 | 8/1962 | Heisig | 252/56 R |
| 3,923,671 | 12/1975 | Knepp | 72/42 |
| 4,132,662 | 1/1979 | Sturwold | 72/42 |
| 4,390,438 | 6/1983 | Kennedy et al. | 72/42 |
| 4,452,711 | 6/1984 | Laemmle | 72/42 |
| 4,800,034 | 1/1989 | Akao | 252/56 R |

FOREIGN PATENT DOCUMENTS

| | | | |
|---|---|---|---|
| 0017148 | 5/1972 | Japan | 252/56 R |
| 160396 | 9/1983 | Japan | 72/42 |
| 0187493 | 11/1983 | Japan | 252/56 R |
| 0161487 | 8/1985 | Japan | 252/56 R |
| 1165304 | 9/1969 | United Kingdom | 252/56 R |

*Primary Examiner*—Prince E. Willis
*Assistant Examiner*—Ellen M. McAvoy
*Attorney, Agent, or Firm*—Fleit, Jacobson, Cohn, Price, Holman & Stern

[57] ABSTRACT

A method in the processing of aluminum is disclosed, wherein oil from a supply is sprayed onto the aluminum which is processed, whereafter it is collected and passed through a filter and then back to the supply. According to the invention the oil which is used is one which as an additive contains a flocculant selected from the group consisting of dicarboxylic acids having the general formula: HOOC—A—COOH, wherein A is a straight or branched alkylene group of 5–14 carbon atoms or phenylene. The invention also comprises the use of a dicarboxylic acid having the above formula as a flocculant in an oil for the processing of aluminum.

8 Claims, No Drawings

METHOD IN THE PROCESSING OF ALUMINUM AND THE USE OF CERTAIN ACIDS IN OILS THEREFOR

The present invention relates to a method in the processing of aluminium and the use of certain compounds as flocculants in an oil for the processing of aluminium.

In the processing of aluminium, e.g. rolling, wire drawing and cutting processes, an oil is often used, which is sprayed onto the aluminium which is processed and which oil is then collected, passed through a filter and recirculated. During the processing great amounts of small aluminium particles are formed which give the oil a dark colour. As a result of oxidation of the oil acid products are formed, which can react with the aluminium particles to form soaps. The acids and the soaps can be adsorbed to the aluminium particles with the polar parts facing the metal surface and the oil like parts facing the oil. The result of the adsorption is a sterical stabilization of the particles so that they do not settle but are kept suspended in the oil. The protective oil film around the particles also has the effect that the particles do not get caught in the filter but pass therethrough without the oil being decoloured.

The brown-coloured particle-containing oil often results in a brown staining of the foil which is prepared. Another disadvantage is that particles in the oil on milling of aluminium to a thin foil can cause perforations to be formed in the foil.

An object of the present invention is therefore to find additives to the oil, which break the sterical stabilization of the particles and enables the particles to be filtered off to give a clear colourless oil.

According to the present invention it has now been found that the above object is achieved by adding as a flocculant to the oil a compound from the group consisting of dicarboxylic acids having the general formula

HOOC—A—COOH wherein A is a straight or branched alkylene group of 5–14 carbon atoms or phenylene.

In accordance with the above the invention relates to a method in the processing of aluminium, wherein oil from a supply is sprayed onto the aluminium which is processed whereafter it is collected and passed through a filter and then back to the supply, which method is characterized in that an oil is used which contains a flocculant selected from the group consisting of dicarboxylic acids having the general formula

HOOC—A—COOH wherein A is defined as above.

When A is a branched alkylene group, each branch preferably contains at most two carbon atoms Examples of such branched acids are 3-methyladipic acid and diethylmalonic acid.

Particularly preferred are such acids of the above formula wherein A is an alkylene group of 7 or 8 carbon atoms in a straight chain (azelaic acid and sebacic acid, respectively), especially the first-mentioned acid.

Examples of acids, wherein A in the above formula is phenylene, is phthalic acid.

The amount of the flooculant in the oil should be sufficient to make the user of the oil consider the additive effective. Preferably the concentration amounts to at least 50 ppm calculated on the total weight of the oil.

On account of the limited solubility of the flocculant in the oil the concentration of the flocculant is suitably lower than that corresponding to the limit of the solubility of the flocculant in the oil. When the oil is supposed to be subjected to varying temperature conditions consideration should be paid to the variation of the solubility with temperature in order to prevent the separation of dicarboxylic acid from the oil.

On delivery to the consumer the oil suitably should have a high content of the flocculant, preferably about 500 ppm, the oil thus delivered being mixed at the place of use with used oil which has become impoverished of flocculant.

The basic oil of the oil used according to the invention is of a conventional type for the respective field of use, usually a naphthenic or paraffinic oil of low viscosity, and contains additives which are conventional in connection with the use, such as for instance, antioxidants and lubricity additives in conventional amounts.

An example of common antioxidants in this connection is butylated hydroxytoluene (BHT; 2,6-di-tert.butyl-p-cresole).

Usually lauryl alcohol, butyl stearate or lauric acid is used as the lubricity additives.

According to a preferred embodiment of the method according to the invention the content of the flocculant of the oil is controlled during the processing to fall within the range of 50–100 ppm by means of the addition of a concentrate consisting of the flocculant dissolved in N-methyl-2-pyrrolidone (NMP), preferably the highest concentration possible.

The need for an addition of concentrate of flocculant to the oil during the processing is established, for instance, by measuring the acid value of the oil. The range of 50–100 ppm for the content of the dicarboxylic acid is corresponded approximately by the range of 0.03–0.06 for the acid value.

A suitable composition of the concentrate is, for instance, 40 % by weight of acid and 60 % by weight of NMP. The solution of the acid is preferably made as concentrated as possible without risking precipitation to occur. Attention should also in this case be paid to the variation of the solubility with temperature in order to prevent precipitation on changes in temperature, e.g. from indoor to outdoor conditions.

According to another aspect of the present invention the invention also relates to the use of a dicarboxylic acid having the general formula

HOOC—A—COOH, wherein A is defined as above, as a flocculant in an oil for the processing of aluminium.

The invention will be further described in the following by means of a number of working examples without being limited thereto, however.

EXAMPLE 1

A concentrate of azelaic acid dissolved in N-methyl-2-pyrrolidone (weight ratio 40:60) was mixed into a used rolling oil of a conventional type on basis of naphthenic mineral oil of low viscosity from the rolling of aluminium and containing 290 ppm of aluminium to a concentration corresponding to the acid value of 0.29. A working tank was filled with this mixture and the oil was recirculated via a filter having a filter area of 0,075 $m^2$. Celite ® 545 was used as a filter aid. The volume of the system was about 60 1. Samples were taken after the filter.

The flow and the filter pressure at the starting of the experiment was 10 l/minute and 0.6 kg, respectively. The filter pressure increased very rapidly during the experiment and after 4 minutes it was 2.0 kg and the colour of the oil abated successively. The filter was changed at the filter pressure of 2.6 kg. The flow at that occasion was 1 l/minute.

Analysis data showed that the content of aluminium had decreased to one third after 30 minutes and that after one change of filter and 60 minutes of filtering the content of aluminium was below the limit for detectability (2 ppm) and the oil was clear and colourless. The acid value was stabilized at about 0.09 which indicates that the additive is not too rapidly leached from the oil by the filter.

The results are shown in the Table below.

| Time minutes | Acid value | Al ppm | Appearance | Remarks |
|---|---|---|---|---|
| 0 | 0.01 | 290 | Black | Without any addition of flocculant |
| 5 | 0.09 | 190 | Black | Precipitation which settles |
| 20 | 0.09 | 140 | Black | Precipitation which settles |
| 30 | 0.09 | 100 | Black | Precipitation which settles |
| 90 | 0.09 | 18 | Bright turbid | After a first change of filter |
| 60 | 0.09 | <2 | Bright turbid | |
| 80 | 0.09 | <2 | Slightly turbid | |
| 110 | 0.09 | <2 | Clear, colourless | |
| 140 | 0.09 | <2 | Clear, colourless | |

When oil without flocculant was circulated in the system before the start of the experiment in order to cover the filter with filter aid the pressure was stabilized at 0.4 kg but the colour of the oil was not changed.

EXAMPLE 2

In a rolling mill for aluminium sheet rolling oil was sprayed onto the sheets. The oil was taken from a tank having a holding capacity of 40 $m^3$ and the oil was collected in a second tank and pumped through a filter, diatomaceous earth being used as a filter aid, and then back to the first tank. (Two filters were used, which were used and regenerated alternatingly.)

The oil was initially a conventional rolling oil on the basis of naphthenic mineral oil of low viscosity and containing BHT as an antioxidant and lauryl alcohol as a lubricity additive.

At about half full storage tank with strongly dark coloured oil 20 $m^3$ of an oil were refilled, which differed from the conventional oil by containing about 500 ppm of azelaic acid as a flocculant which took place on April 24.

Every day during the operation of the plant the acid value was measured and a concentrate consisting of azelaic acid dissolved in NMP in the weight ratio acid: NMP=40:60 was added in an amount of 1-3 l to the tank to maintain an acid value in the range of 0.04-0.06 (corresponding to a concentration of acid of about 65-100 ppm) in the oil.

When the amount, of oil in the tank had decreased to about half thereof about 20 $m^3$ fresh oil containing about 500 ppm of azelaic acid were refilled.

Until the end of the experiment on September 2 fresh oil of about 20 $m^3$ was refilled on 4 occasions and 54 l of concentrate in total were used. After an initial decolourizing the oil remained clear and colourless during the whole experiment.

EXAMPLE

A dicarboxylic acid as set forth below dissolved in NMP was added to a concentration of 0.05.% by weight to a used rolling oil for aluminium consisting of a thin mineral base oil (94.85 % by weight), lauryl alcohol (5.0 % by weight) and antioxidant (0.15 % by weight).

Experiment 1: 1,10-decanedicarboxylic acid.
Experiment 2: Diethylmalonic acid.
Experiment 3: 3-methyladipic acid.
Experiment 4: Orthophthalic acid.
Experiment 5: Sebacic acid.

Before the addition of the dicarboxylic acid the rolling oil was coloured black by aluminium particles, which could not be removed by means of filter paper. After standing for about 2 h with the different dicarboxylic acids the oils were filtered.

Results: All the oils were clear and colourless after the filtering.

I claim:

1. A method of processing aluminum comprising the steps of:

(a) spraying oil from a supply onto the aluminum which is processed;

(b) collecting the oil thereafter; and (c) passing it through a filter and then back to the supply, wherein the oil consists essentially of an oil with a flocculent dissolved therein which flocculent is selected from the group consisting of dicarboxylic acids having the formula

HOOC—A—COOH wherein A is a straight or branched alkylene group of 5-14 carbon atoms or phenylene.

2. The method of claim 1, wherein the concentration of the flocculent of the oil is at least 50 ppm calculated on the total weight of the oil and less than the concentration corresponding to the limit for the solubility of the flocculent in the oil.

3. The method of claim 1, wherein the concentration of the flocculent of the oil during the processing is controlled to fall within the range of 10-100 ppm by adding a concentrate consisting essentially of the flocculent dissolved in N-methyl-2-pyrrolidone.

4. The method of claim 3, wherein said flocculent is present in the highest concentration possible in said concentrate.

5. The method of claim 1, wherein the flocculent is azelaic acid or sebacic acid.

6. The method of claim 1, wherein the oil is a naphthenic or paraffinic oil of low viscosity.

7. The method of claim 1, wherein the oil further consists essentially of at least one additive.

8. The method of claim 7, wherein said at least one additive is selected from the group consisting of antioxidants and lubricity additives.

* * * * *